United States Patent [19]

Ressa

[11] 4,017,011

[45] Apr. 12, 1977

[54] THREADING DEVICE

[76] Inventor: Rick P. Ressa, E. 505 Parkhill Drive, Spokane, Wash. 99208

[22] Filed: Feb. 17, 1976

[21] Appl. No.: 658,184

[52] U.S. Cl. ..... 223/102

[51] Int. Cl.[2] ..... D05B 85/00

[58] Field of Search ..... 223/102; 66/116, 117, 66/118; 128/339

[56] References Cited

UNITED STATES PATENTS

| | | | |
|---|---|---|---|
| 342,725 | 5/1886 | Arnold | 223/102 X |
| 386,723 | 7/1888 | Smith | 223/102 |
| 2,096,483 | 10/1937 | Cook | 66/117 |

*Primary Examiner*—George H. Krizmanich

*Attorney, Agent, or Firm*—Wells, St. John & Roberts

[57] ABSTRACT

A threading device that provides a multi-strand thread integrally connected to a wire cable needle at one or both ends thereof. The thread is formed of at least one thread filament that is folded onto itself to form a bundle of strands with filament bends at the end of the thread. At least one wire filament is also provided that is folded onto itself to form wire filament bends that are interlocked with the corresponding thread filament bends. The joined bends of the thread filament and wire filament form a tapering interlocking interconnection that extends integrally between the thread and the needle. The thread and wire strands are twisted in opposite directions about a longitudinal axis to bind the wires and strands to form an elongated integral threading device with a tapering wire cable needle at one or both ends thereof. The needle tapers from a reduced end to the cross-sectional dimension of the thread. The interlocking interconnection tapers due to selective layout of the successive interconnected thread filament bends and wire filament bends. The bends are spaced apart longitudinally along the axis of the device before it is twisted. Therefore, the total cross-sectional dimension of the combined strands is not produced abruptly in the finished twisted product but is introduced gradually along the length of the interlocking interconnection.

2 Claims, 4 Drawing Figures

10
11
12
13
14
15
16
18
19
20a
20b
20c
21a
21b
21c

THREADING DEVICE

BACKGROUND OF THE INVENTION

The present invention relates to the field of threading devices and more particularly to such devices utilizing twisted wire in combination with thread strands to form a needle or pointed end at one or both ends of a thread. Cobblers, saddlemakers, upholsterers, and others have long been acquainted with the problem of threads separating from the attached needle during sewing operations. Many attempts have therefore been made to overcome this problem by providing a more secure attachment between a needle or "inductor" and the attached thread.

Often, shoemakers and saddlemakers utilize a relatively thick thread that is comprised of several waxed thread strands. This thick thread is attached to a twisted wire or "bristle" that tapers to a point. The twisted wire is connected to the thread through spaces left between the wound wire. The thread is inserted through the wire spaces. Then the wire is tightened by further twisting about the thread. The difficulty presented in this situation is that a free end of the thread is exposed and will often catch as the wire "needle" is pulled through a heavy material.

An example of a wire needle and its attachment to a thread as basically described above, is given in U.S. Pat. No. 342,725 to W. B. Arnold granted May 25, 1886. Arnold discloses a "waxed end" that is comprised of intermingled wires and thread strands. The end is prepared by laying out the thread strands one next to another with loose ends matching longitudinally. A number of wires are then placed between the strands so that their lengths overlap a portion of the strands but extend beyond the strand ends. The strands and loose wires are then gathered and twisted together so that the wires will be interwoven with the twisted strands. The strand ends will be situated rearwardly of the wire "cable" end that is formed from the twisted portions of the wires that extend beyond the ends of the strands. This structure and method for producing this structure facilitates continuous production of successive strands interconnected by the wire "needles" in a continuous integral length, so that a user may cut successive lengths from a roll.

The difficulty presented with this arrangement is that strands ends are exposed and face the material into which they are to be pulled. Therefore, these ends may catch on the material and be pulled rearwardly away from engagement with the interwoven wires. At best, the strand ends will fray and enlarge the effective diameter of the threading unit. Under more strained conditions, the thread strands will completely separate from the needle in the midst of a sewing operation.

U.S. Pat. No. 386,723 to J. T. Smith, issued July 24, 1888, discloses another form of "wax end" needle. In this form, a single wire is doubled over onto itself and is twisted together, leaving three successive slits along its length between windings. The thread is attached to this needle by weaving a free end thereof through the three slits. Once this is done, the slits may be closed by twisting the wire end tightly about the thread at the three locations. The forward end of the thread is exposed, facing the material during sewing operations. Thus, it may also fray and enlarge the effective cross-sectional size of the entire threading unit. This device, however, does provide a reasonably good connection between the wire needle, and cord or thread.

A very similar device is also shown in U.S. Pat. No. 183,173 granted to H. M. Jenkins and issued on Oct. 10, 1876. The disparity between Jenkins' and Smith's devices is that Jenkins' utilizes a pair of wires wrapped about each other and a single aperture or slit through which the thread is attached. Operational features of the Jenkins' needle or "bristle" are similar to that provided by Smith.

It is a primary object of the present invention to provide an integral needle and a multi-strand thread arrangement whereby no loose thread filament ends may possibly face the material to be sewn.

Another object is to provide such an integral unit that tapers from an effective cord diameter to a reduced wire cable end to thereby enhance threading capability.

A still further object is to provide a threading device in which the effective cross-sectional size of the "needle" is never greater than the effective cross-sectional size of the thread attached therewith.

A still further object is to provide such a device that is relatively simple in construction and may be quickly and efficiently produced.

An additional object is to provide such a device that may be produced in a continuous length and stored on a spool so successive units may be pulled and cut from the continuous length.

These and still further objects and advantages will become apparent upon reading the following description which, taken with the accompanying drawings, will disclose preferred and alternate forms of the present invention.

DETAILED DESCRIPTION OF PREFERRED AND ALTERNATE EMBODIMENTS

Figures 1, 2, 3, 4:
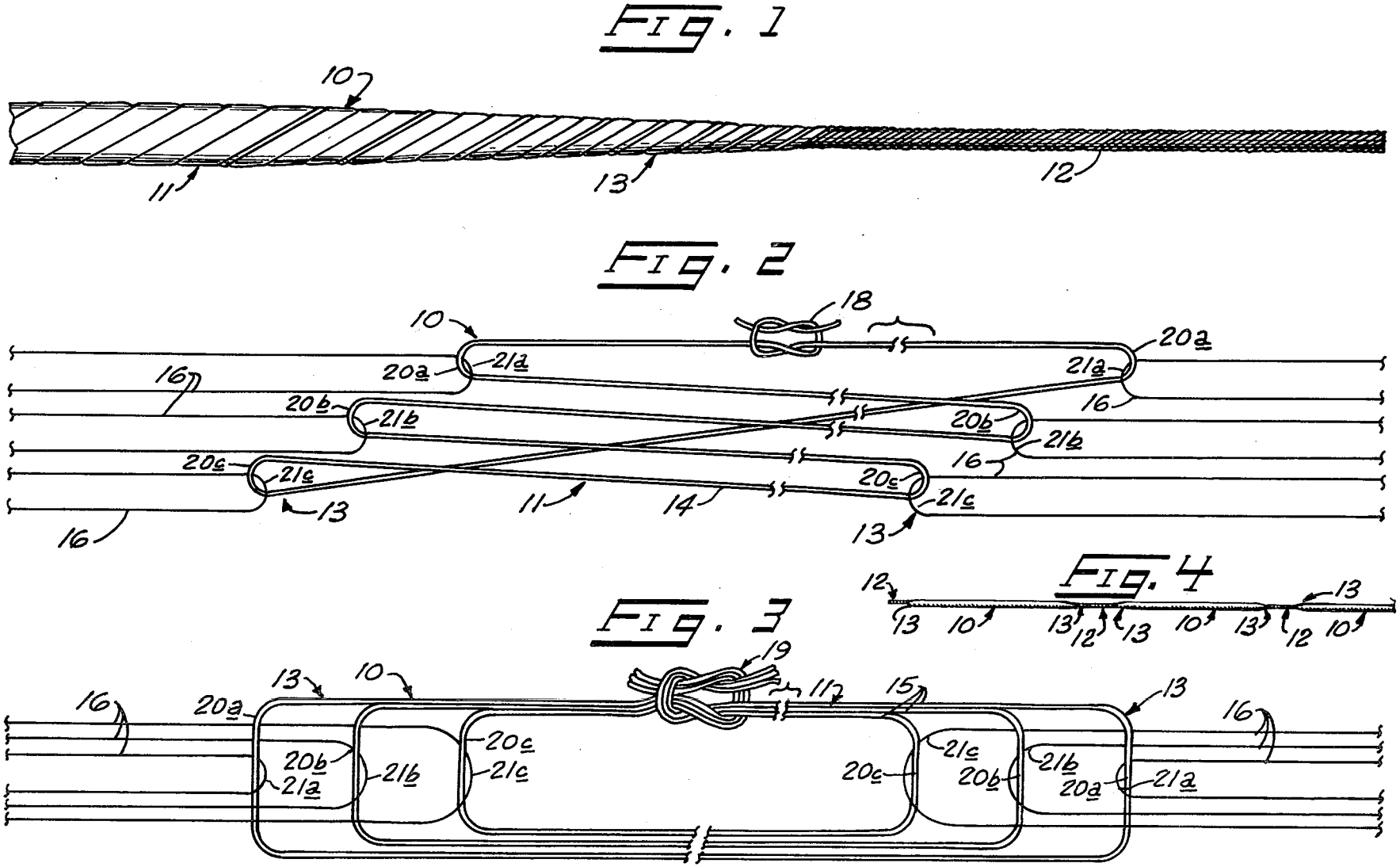
FIG. 1 is an enlarged fragmentary view of one end of the present threading device.
FIG. 2 is a schematic view illustrating the construction of a preferred form of the present device.
FIG. 3 is another schematic view illustrating an alternate construction of the present device.
FIG. 4 is a reduced fragmentary view showing several devices in a continuous form.

The threading device embodying a preferred and an alternate form of the present invention is illustrated in the accompanying drawing and is generally designated therein by the reference character 10. Basically, both forms of the device include an elongated, flexible multistrand thread 11 attached integrally to a wire cable needle 12 by an interlocking interconnection 13. The two embodiments are shown by FIGS. 2 and 3. A preferred form is illustrated in FIG. 2 wherein the thread is formed of a single thread filament 14. The alternate form shown by FIG. 3 includes a plurality of separate thread filaments 15.

It should be understood that the present device may be produced in several forms, some of which are not shown in the drawings. For example the device could be provided with a single needle at one end of a multistrand thread. Such thread may be composed of one or more folded thread filaments. Or, the device may be produced as shown in the drawings with identical needles 12 at both ends of the thread 11. Another consideration to bear in mind is that device 10 may be produced as shown in FIG. 4, with its opposed wire cable needles 12 formed integrally with wire cable needles 12 of adjacent devices in a continuous length of interconnected individual threading devices.

The preferred form of device as shown in FIG. 2 includes a single thread filament 14 that is folded back onto itself several times to define the multiple strands. The opposed free filament ends of the filament are tied together by a knot 18, forming a series of individual strand loops. Similarly, the ends of individual filaments 15 (FIG. 3) of the alternate form are tied together by a knot 19 to form individual loops. It is understood that the separate ends of filaments 15 could also be tied by individual knots.

The thread filament is folded back onto itself to form a bundle of multi-strands having end loops defining a first series of filament bends 20*a*, 20*b*, and 20*c*. These bends 20*a* through 20*c* are specifically located along the length of the thread so that they are longitudinally spaced from one another. This is an important feature of my invention, since the spacing determines the final tapering configuration of the interconnections 13.

The typical wire cable needle 12 is comprised of at least one wire filament 16 that is folded onto itself to define a cross-sectional bundle of wire strands. Several individual filaments may be formed by folding one wire onto itself several times and then cutting through the folded thickness. The needle 12 is joined to the thread 11 by the interlocking interconnection 13 that extends integrally from the thread 11 to wire needle 12. The interconnection 13 tapers from the full cross section of the thread to a reduced cross-sectional size at the cable needle 12. FIG. 1 is a detailed view illustrating the cable needle 12 and integral connection 13. The diameter of the wire filament 16 is less than the diameter of the thread filament 14.

The folded loops of wire filament 16 define a number of wire filament strands equal to the number of strands in the thread. The wire filament also includes a number of wire filament bends 21*a*, 21*b*, and 21*c* that correspond to the thread filament bends 20*a* through 20*c*. The corresponding bends 20*a*, 21*a*; 20*b*, 21*b*; and 20*c*, 21*c* are interthreaded and longitudinally offset along the length of the thread. The corresponding joined portion of the wire filament and thread filament comprise the integral interconnection 13.

It is preferable to use metal musical wire that is substantially smaller in cross-sectional dimension than the corresponding thread filament cross-sectional dimension. The metal wire is flexible and may be easily twisted together to form the wire cable needle 12. The needle will flex rather easily when so desired during the sewing operation.

In the finished product, the wire filament and thread filament are twisted from opposite ends and in opposite directions about a longitudinal axis. This twisting consolidates both the thread strands and wire strands into a single integral unit. Often to maintain the thread in a twisted state, a shoemakers wax is utilized to bind the twisted strands together. The wire filament will retain its twisted nature without the aid of shoemakers wax. The needle end is dipped in molten lead or solder to prevent fraying of the wire filament ends.

FIG. 1 shows the end of a single threading unit 10 and in particular the transition from the thread to the wire needle provided by the integral interconnection 13. This interconnection 13 gradually tapers because the interfitting bends 20*a*, 21*a* through 20*c*, 21*c* are spaced apart longitudinally. Through such spacing, the corresponding cross-sectional size of the unit progressively decreases from the thread 11 to the needle 21 through the interconnection 13.

The drawings show the thread filament as broken to indicate that the effective length of the thread may vary according to required use. It is not unusual to have a thread length of approximately 10 feet and wire cable needles thereon of only several inches in length.

A single wire filament may also be provided, that is folded back onto itself to form several loops in a fashion identical to that shown for the thread filament. In doing this, matching sets of bends are provided at opposite ends of folded filament loops. Both sets of wire bends on a single folded wire filament may be interconnected with thread bends of two separate threads. By interconnecting successive thread lengths to common wire filaments, a single continuous unit may be produced as shown in FIG. 4 of the drawings. Separate threading devices may be selectively removed from the continuous length by cutting through the spaced wire cable needles 12.

Ordinarily, a double-ended device, (having a needle 12 at each end) will be utilized for sewing with relatively long lengths of thread 11. A double needle threading device enables a shoemaker, saddlemaker, luggage maker, etc. to use a continuous thread over a substantially long seam length without making it necessary that he pull the full thread length through each time he forms a stich. Instead, he may start at the approximate center of the seam length and stitch in opposite directions from this center. Therefore, he need only pull approximately one half the thread length each time he completes a stitch.

It is understood that such devices do not neccessarily need to be produced in a single continuous length with separate threading devices connected end-to-end by integral wire cable needles. To the contrary, such a device may be formed as is shown by FIGS. 2 or 3 as a unit by itself.

It is also understood that different materials may be utilized in construction of the present invention and that other forms may be envisioned upon inspection of the drawings and by reading the above description. Therefore, only the following claims are to be taken as restrictions upon the scope and as definitions of my invention.

What I claim is:

1. An elongated threading device, comprising:

an elongated flexible multi-strand thread;

an elongated wire cable needle;

an interlocking interconnection extending integrally between the thread and the needle;

said thread being constructed of one or more thread filaments that are folded back upon themselves to define multiple thread strands with at least two thread filament bends at an end of the thread;

said wire cable needle being constructed of one or more wire filaments that are folded back upon themselves to form a number of wire strands and wire filament bends corresponding to the number of thread filament bends;

said thread filament bends and wire filament bends being interthreaded and longitudinally offset along the threading device to form said interlocking interconnection between the thread and cable needle; and wherein the thread strands and wire strands are twisted in opposite directions about a longitudinal axis to form the device.

2. The elongated threading device as defined in claim 1 wherein the elongated flexible multi-strand thread has opposite ends and wherein the device includes an elongated wire cable needle at each end of the thread with interlocking interconnections extending integrally between the thread and needle at each end and wherein the one or more thread filaments are folded back and forth upon themselves to form at least two longitudinally offset thread filament bends at each end of the thread and wherein each needle includes one or more wire filaments that are folded back upon themselves to form at least two longitudinally offset wire filament bends interthreaded with respective thread filament bends.

* * * * *